US005137386A

United States Patent [19]

Mower

[11] Patent Number: 5,137,386

[45] Date of Patent: Aug. 11, 1992

[54] WALLBOARD SPOTTER TOOL

[75] Inventor: Morris F. Mower, Santa Clara, Calif.

[73] Assignee: Axia Incorporated, Oak Brook, Ill.

[21] Appl. No.: 693,947

[22] Filed: Apr. 29, 1991

[51] Int. Cl.[5] ..... B28B 3/00

[52] U.S. Cl. ..... 401/48; 401/171; 401/176; 401/193; 425/87

[58] Field of Search ..... 401/5, 48, 176, 193, 401/171, 48, 176, 171, 193; 425/87

[56] References Cited

U.S. PATENT DOCUMENTS

| | | | |
|---|---|---|---|
| 1,409,037 | 3/1922 | Starkey et al. | 401/193 X |
| 2,666,323 | 1/1954 | Ames | 401/48 X |
| 2,711,098 | 6/1955 | Ames . | |
| 2,809,513 | 10/1957 | Ames | 401/48 X |
| 2,824,442 | 2/1958 | Ames | 401/48 X |
| 2,889,699 | 6/1959 | Ames | 425/87 |
| 3,103,033 | 9/1963 | Ames | 401/171 |
| 3,451,757 | 6/1969 | Stroud et al. | 401/171 X |
| 3,888,611 | 6/1975 | Ames | 401/48 X |
| 4,230,441 | 10/1980 | Heronema | 425/87 |

*Primary Examiner*—Steven A. Bratlie

*Attorney, Agent, or Firm*—Laff, Whitesel, Conte & Saret

[57] ABSTRACT

A tool for applying mastic (mud) to drywalls during the installation thereof. The tool has a quick opening feature for cleaning or manually filling a cavity with mastic. The tool is pivotally connected on the end of a handle with a controlled friction. A double-edged blade shapes the mastic as it is applied to the wall. The blade may be reversed when one edge becomes nicked or otherwise unusable.

8 Claims, 3 Drawing Sheets

WALLBOARD SPOTTER TOOL

This invention relates to tools for use during the installation or repair of wallboard or drywall and more particularly to applicators for filling recesses in the wallboard or drywall with a mastic.

The inventive tool is related to tools which are shown and described in U.S. Pat. Nos. 2,809,513 and 2,711,098, for example.

During the erection and installation of wallboard or drywall, many things may occur which leave small holes, dimples, or other irregularities in the surface of a wallboard panel. For example, these panels are usually held in place by nails or screws which are set into the wallboard so that the nail or screw heads do not show. This leaves a small hole in the surface which is perhaps an eighth of an inch or so deep. On other occasions, something may bump into the wall and leave a nick or gouge. Regardless of how they got there, small recesses, depressions, or dimples must be filled with a suitable mastic (sometimes called "mud") to give a smooth plaster-like surface. The tool which fills the holes or recesses is commonly called a "nail spotter", because it fills a nail hole with a "spot" of mastic.

Finishing drywall or wallboard surfaces under these conditions is basically a multi-step process, with a drying phase between each step. A bedding coat of joint compound or other mastic applied by a nail spotter tool fills the recess formed in the wallboard and may or may not be reinforced with a tape, depending upon the size of the recess. After the mastic applied by a nail spotter tool or compound is applied and while it is still wet, any excess compound should be wiped down. The compound or mastic often shrinks as it dries. This shrinkage results in slight depressions that are filled by applying topping and finishing coats of the mastic or compound. The inventive nail spotter device may also be used to apply a finishing coating which fills these slight depressions, depending largely upon their size. In general, the device should be wide enough to not only fill the entire depression, but also to spread onto and rest against the surrounding wall.

The finish coat of mastic or compound is applied in a manner which is similar to the application of the first coat. However, the finish coat is a thin layer that feathers out into the field of the wallboard which surrounds the depression. This finish coat fills minor unevenness and shrinkage that could show shadows after painting. A wide tool (about 10–12") is used for wide depressions, and a narrow tool (about 3") is used for nail holes. Either way it is necessary to fill and clean the finishing tool.

The topping coat brings the joint flush with the surrounding wallboard surface after drying. Therefore, there must be compensation for shrinkage. Thus, the tool has a precise crown over and along the center of the applied compound or mastic which applies a thicker coat at a point where it will shrink to become flat.

Usually, the finish coat is enough for an effective, attractive result. However, there may be times when the final decoration or other specifications make it critical to have a nearly perfect drywall base. On such occasions, a fourth application, or skim coat, may be applied by a use of the same technique.

Sometimes, as when filling nail holes, a row of dimples can be filled in one pass with the inventive tool. The tool makes positive contact with the wallboard surface at the beginning of the row, and then is drawn smoothly along the entire row, while applying a moderate pressure to force compound onto the wallboard surface and into the dimples. A blade on the tool skims off excess compound and leaves a slight crown directly over each dimple as the tool floats along on the wallboard. After passing over the last dimple, contact with the surface of the wallboard is gradually broken with a sweeping motion, in order to properly fill the dimples without leaving excess mastic or compound which must then be removed by hand.

Regardless of how the tool is used, it is necessary to load, unload, and clean the tool. It has a box-like open area into which the mastic or compound is pumped. Or, in the alternative, various techniques may be used to fill the tool by hand when no pump is available. The tool must be refilled and cleaned often. Some of the mastic dries relatively fast so that if it is not cleaned promptly, small hard bits will collect to prevent a smooth uniformity to the deposited material. Sometimes the drying material may interfere with, obstruct, or perhaps even immobilize tool parts. Thus, it becomes necessary and desirable to reduce the time required to clean the tool and to eliminate configurations within the tool which may tend to collect debris that cannot be adequately cleaned.

Accordingly, an object of the invention is to provide new and improved tools for applying mastic or compositions to wallboards or drywalls. In particular, an object is to provide a tool which is easily filled with mastic and is easily cleaned. Another object is to provide a leading blade which may be used as a trowel for scraping off material which might be spilled on the wall.

Yet another object of the invention is to provide a tool which is easier to guide or steer as it is moved over the wall.

In keeping with an aspect of the invention, these and other objects are accomplished by a tool which has a cavity for containing a mastic or composition. A toggle mounted pair of wheels roll along a surface of the wall to assist in steering or guiding the tool across the surface. The cavity is closed by a pressure plate which squeezes the mastic or composition out of the cavity. A housing panel or base plate and the pressure plate pivot away from the housing in order to open the cavity and to expose those plates for easy filling and cleaning.

A preferred embodiment of the invention is shown in the attached drawings, wherein:

FIG. 1 illustrates how the inventive tool may be used;

FIG. 2 is a simplified figure taken from expired U.S. Pat. No. 2,809,513 showing a prior art device;

FIG. shows a worker using the inventive tool 20 for depositing mastic into a row of nail holes 22 which may be formed in a wall panel. As here shown, the tool has an elongated handle 24 which may be used to hold the tool against and the pull it along the wallboard. As it is so pulled, a strip of mastic 26 is spread over the row of holes 22. A blade on the tool spreads and levels the strip of mastic as it is deposited, leaving a slight crown.

Figure 1:
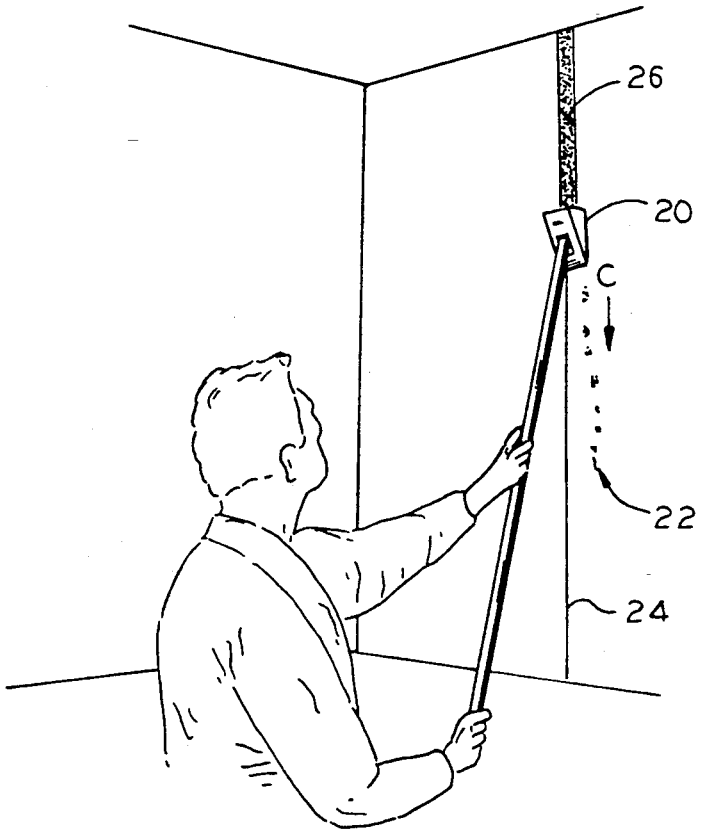
Figure 2:
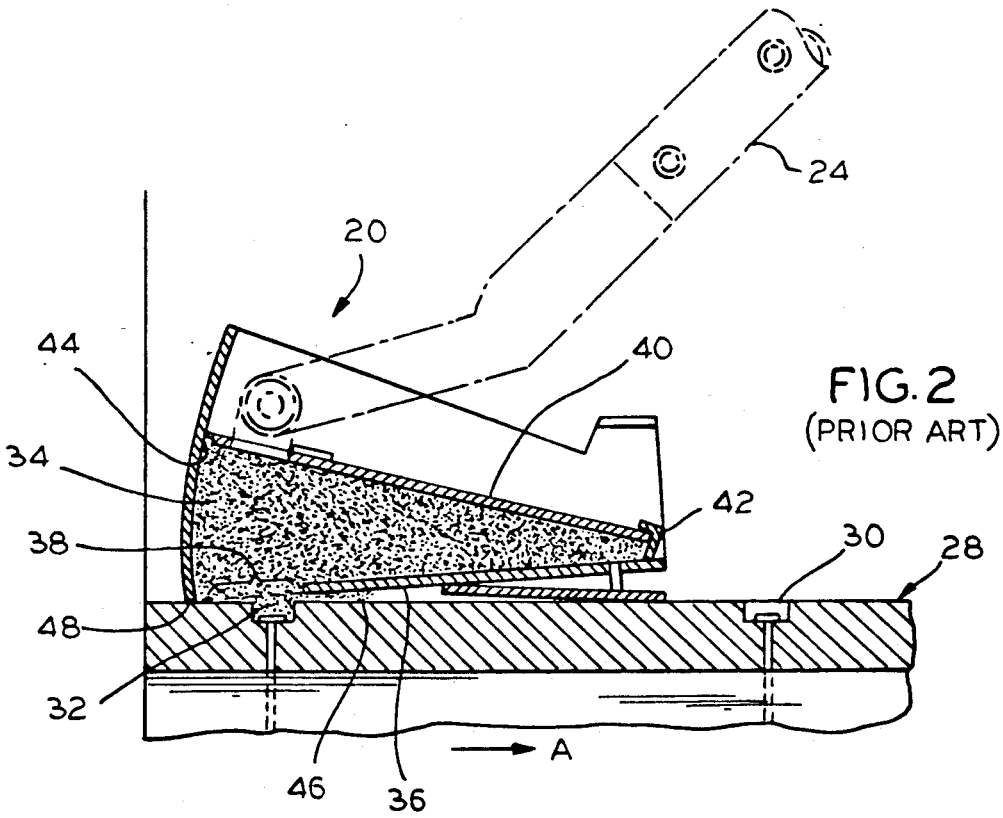
FIG. 2 (PRIOR ART)

The operation of a conventional tool is illustrated in FIG. 2. A wall panel 28 has nail holes 30, 32, for example. The tool 20 includes a cavity which is filled with a mastic or composition 34. The bottom of the cavity is closed by a base plate housing an orifice 38 formed therein. A pressure plate 40 is pivoted at 42 to swing over an arc 44 for squeezing the mastic out the orifice 38 as the tool is moved in direction A. As here shown, the tool is laying a strip of mastic 46 upon the wall. This is substantially the same as the strip 26 of FIG. 1. As here shown, the mastic has filled the hole 32. A blade at 48 scrapes the excess mastic off the wall, leaving the nail hole 32 filled with little or no excess mastic on the wall. Ideally, enough excess mastic remains on the wall so that, with normal shrinkage as the mastic dries, the wall would be left smooth. However, since some shrinkage is almost certain, a second coat may be required.

When all of the mastic 34 is squeezed out of the cavity, the tool may be refilled or opened and cleaned as may be required. Heretofore, the prior art tool shown in FIG. 2 required a partial disassembly of the tool in order to carry out a cleaning process.

According to the invention (FIG. 3), the tool includes a housing having four walls 35 which define a somewhat rectangular side wall perimeter having opposing top and bottom open sides for supporting a pressure plate and a base plate. A quick disconnect feature enables both the bottom or base plate 36 and top or pressure plate 40 to swing away from the housing 50 for quick and easy cleaning. For a better understanding of this feature, reference may be made to FIGS. 3-7.

The housing 50 includes two side plates 52, 54 which are joined preferably by being staked to an end plate 56. The end plate is arcable with a number of ears which fit through and are attached to matching holes formed in the side plates. The opposite ends of each of the side plates 52, 54 contain two holes which receive screws 62-64 that are turned into screw holes of members 66-72 associated within pressure plates 40 and base plate 36, thus pivotally mounting each of them to the housing 50.

Figure 5:
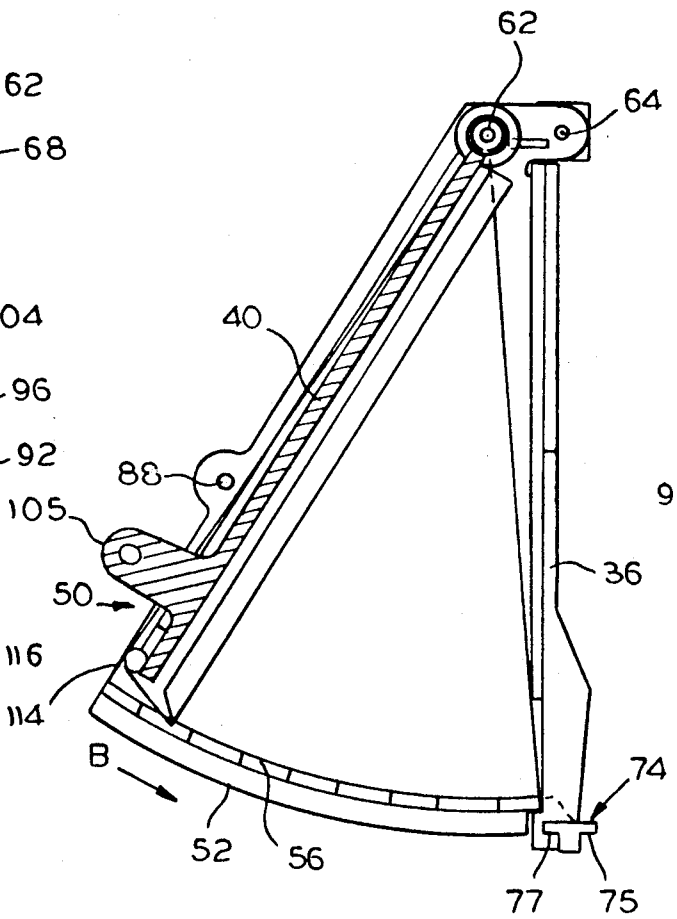
FIG. 5 is a plan view of a side plate for the housing.

Base plate 36 contains the orifice 38 out of which the mastic is squeezed as the pressure plate 40 pivots at 62 and sweeps through the housing 50, in direction B. Mastic may also be pumped through this same opening in order to refill the tool. At the front, the base plate 36 carries a blade 74 attached by screw 76. As is best seen in FIG. 5, the blade 74 has two edges, one 75 of which projects beyond the base plate 36. When that projecting edge is worn, the blade is reversed and the other edge 77 is used. The blade scrapes excess amounts of mastic from the wall. A skid plate 78 surrounds orifice 38 to provide room from the mastic squeezed from housing 40 to fit between the wall and the base plate.

The base plate 36 has an upstanding wall (FIG. 3) at the pivoted end. At 84, a block 82 is bolted to the wall 80 to receive an axle for supporting wheels 86, 86. The wheels have a toggle mounted action pivoting about bolt 82, so that the wheels ride over any irregularities and also follow the worker's guide in case he does not follow a straight line as he lays down a bead of mastic.

Figure 3:
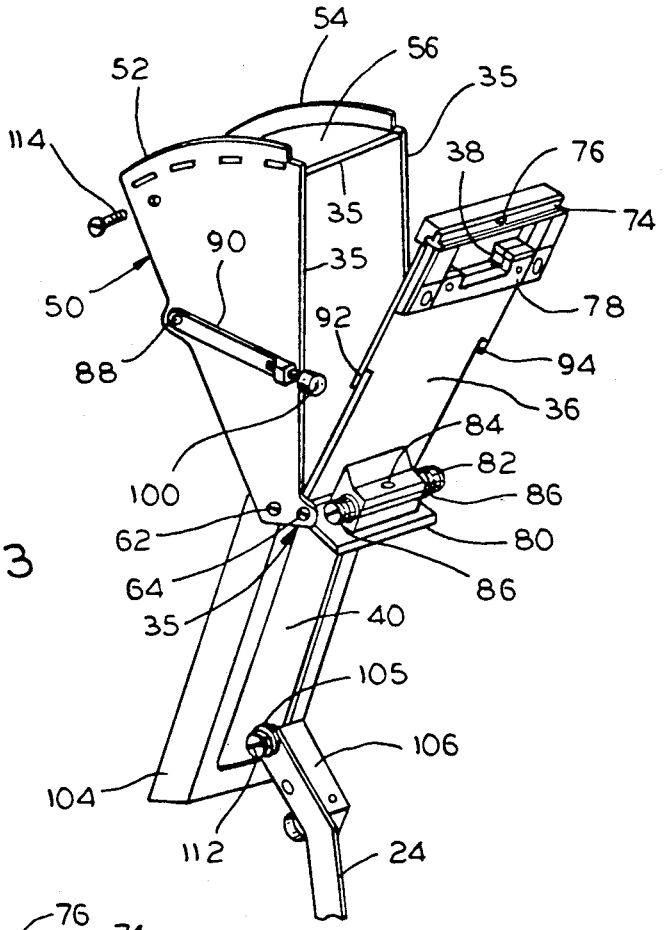
FIG. 3 is a perspective view showing of the inventive tool in an open condition.
Figure 4:
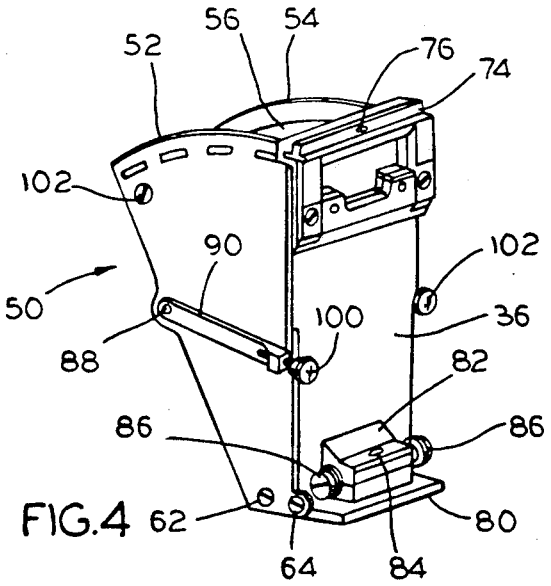
FIG. 4 is a perspective view showing the same tool in a closed condition.

Pivotally mounted at 88, on each of the side plates, is a base plate anchor 90 which is a swinging arm having a knurled head shoulder screw threaded into the end thereof. The base plate has two outstanding ears 92, 94 defining slots 96, 98 for receiving the shoulder screws 100, 102, when the swing arm of anchor 90 swings into a locking position. Then the shoulder screws 100, 102 are tightened to lock the base plate into position. To open the cavity, shoulder screws 100, 102 are loosened and arm 90 is swung out of the slots 96, 98. At that time, the base plate may swing away from the housing as best seen in FIG. 3. Once the cavity is opened, it may be cleaned. This ability to open widely also permits the tool to be filled with mastic by the use of a spatula or putty knife, if that method of filling is desired.

The periphery of pressure plate 40 is surrounded by any suitable elastomer wiper material 104 (FIGS. 3, 7) which wipes the inside wall of the cavity that contains the mastic.

This pressure plate 40 is pivotally connected to handle 24 (FIG. 1) by any suitable upstanding ear 105 which is integrally formed on the plate 40. The ear 105 may be a metal block of material which is attached to plate 40 by screws, welding, staking or the like. As shown in FIG. 3, the handle 24 may be pivotally attached to ear 105 by a nut and bolt.

Figure 8:
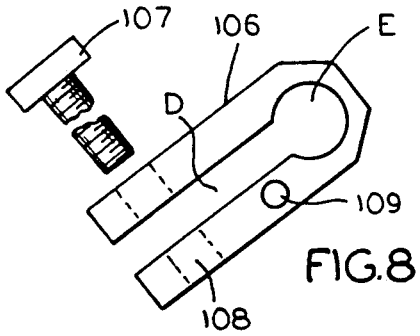
FIG. 8 is a plan view of a handle to head connector.
Figure 9:
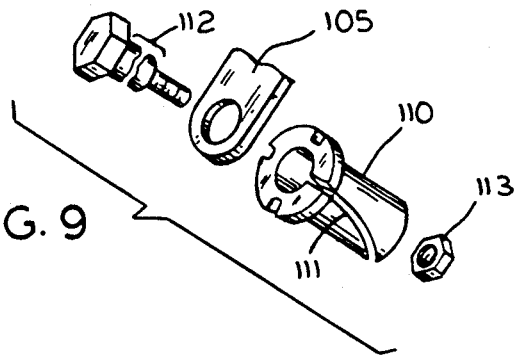
FIG. 9 is a bearing used in conjunction with the connector of FIG. 8.
Figure 6:
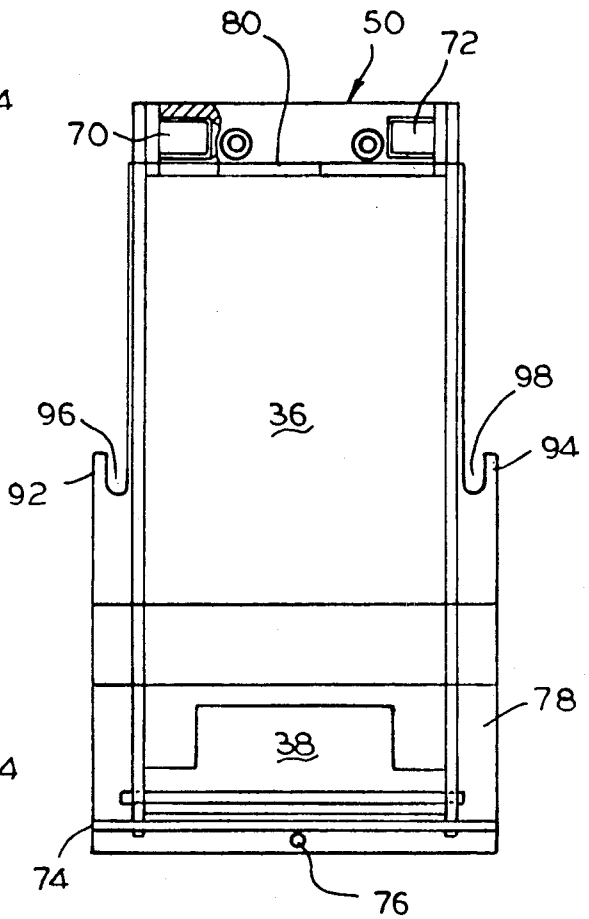
FIG. 6 is a plan view of a housing having a base plate with an orifice for either filling or delivering the mastic to the wall panel.

FIG. 8 shows a connector which is used to attach the head 20 to handle 24 (FIG. 1) in order to maintain a proper posture of the head relative to the wall as the handle is moved. In greater detail, a block of metal 106 includes a slot D leading to a circular opening E. The end of the block containing opening E is relatively thin so that the opening E may be squeezed together by tightening a bolt 107 which is threaded into hole 108 in order to reduce the width of slot D. A bolt hole 109 is used to attach the block 106 to handle 24.

A plastic sleeve 110 having a somewhat spiral slot 111 fits into the hole E to provide a wear resistant surface between the metal block 106 and a bearing surface 112 on a bolt. With the sleeve 110 in place in hole E, the bolt is threaded through a hole in the ear 105, and sleeve 110, and then fixed in place by nut 113. The screw 107 is tightened, squeezing the opening E to provide a desired amount of friction between the handle 24 and head 20. From FIG. 1, it is easy to see that the desired amount of friction holds the head 20 flat against the wall as the worker moves the head up and down.

Figure 7:
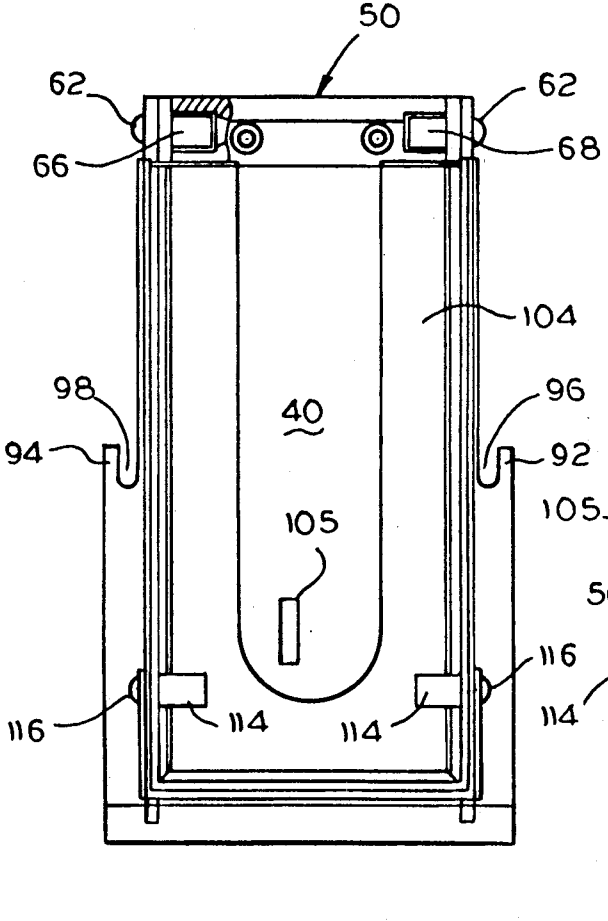
FIG. 7 is a plan view of a housing with a pressure plate for squeezing mastic from the housing.

The worker pushes the head against the wall so that pressure plate 40 is swung into the housing pivoting on screws 62, 62 (FIG. 7). Once the plate 40 is in the housing, it swings as far as stops 114, 114, which are attached to the sides of the housing by screws 116, 116. Normally the pressure plate 40 remains within the housing. Cleaning is done by releasing the base plate 36 by undoing the shoulder screws 100, 102 (FIG. 4) and swinging arms 90 into a release position. However, if necessary, screw 116 may be removed, freeing the pressure plate stops 114, thus allowing the pressure plate 40 to swing free of the housing for full cleaning (as showing shown in FIG. 3).

In operation (FIG. 4), the pressure plate is pulled back to the stops 114 (FIG. 7). Either arms 90 are swung away and a mastic is pressed into the housing by means of a spatula, or a special pump inserts mastic or compound into orifice or opening 38 and the cavity is filled. The worker uses handle 24 to press wheels 84, 86 against the wallboard and to pull the housing in direction C. The worker's muscle-applied power is enough to easily force the mastic or compound out the orifice or openings 38 and into the nail holes.

Those who are skilled in the art will readily perceive how to modify the invention. Therefore, the appended claims are to be construed to cover all equivalent structures which fall within the true scope and spirit of the invention.

I claim:

1. A tool for applying mastic or compound to drywall panel, said tool comprising a housing having a cavity surrounded by at least two opposing closed sides and two opposing open sides, a base plate pivotedly connected to said housing for covering one of said open sides, and a pressure plate pivotedly connected to said housing for covering an open side opposite said base plate, said base plate having an orifice through which said mastic or compound exits said cavity under the urging of said pressure plate, and releasable means pivotally attached to said housing for quickly releasing said base plate for an easy cleaning or filling of said cavity.

2. The tool of claim 1 wherein said pressure plate is surrounded by an elastomer for wiping mastic from the closed sides surrounding said cavity.

3. The tool of claim 1 and a pair of wheels toggle-mounted on an end of said housing where said base plate and pressure plate are pivotally connected to said housing, said wheels rolling along said drywall panel.

4. The tool of claim 1 and a replaceable blade means attached to said housing near said orifice for scraping mastic or compound from said drywall panel, said blade having opposed edges and reversibly mounted on said housing so that said blade can be reversed as it becomes worn or nicked.

5. The tool of claim 1 and a handle joined to said housing, and pivoting means joining said housing and said handle for adjusting the position between said handle and said housing in order to maintain said housing in a proper posture relative to said wall during movement of said handle, said pivoting means including a sleeve having a wear resistant surface, resilient means pivotally mounted around said sleeve for frictionally engaging said wear resistant surface, and means for adjusting the amount of the frictional engagement as desired.

6. The tool of claim 1 wherein said base plate has opposing catches, and said releasable means includes means for selectively engaging or releasing said catches.

7. The tool of claim 6 wherein said catches comprise slots on opposite sides of said base plate and said engaging or releasing means are arms that swing into said slots and capture said base plate when in a closed position.

8. The tool of claim 7 wherein said base plate may be released by said engaging or releasing means to open far enough to enable mastic to be manually placed in said housing.

* * * * *

UNITED STATES PATENT AND TRADEMARK OFFICE

CERTIFICATE OF CORRECTION

PATENT NO. : 5,137,386

DATED : August 11, 1992

INVENTOR(S) : Morris F. Mower

It is certified that error appears in the above-identified patent and that said Letters Patent is hereby corrected as shown below:

Col. 2, line 66, "FIG." should be --FIG. 1--

Signed and Sealed this

Fifth Day of October, 1993

*Attest:*

*Attesting Officer*

BRUCE LEHMAN

*Commissioner of Patents and Trademarks*